US010109964B2

(12) United States Patent
Matsuda et al.

(10) Patent No.: US 10,109,964 B2
(45) Date of Patent: Oct. 23, 2018

(54) JACK DEVICE

(71) Applicant: Panasonic Intellectual Property Management Co., Ltd., Osaka (JP)

(72) Inventors: Goichi Matsuda, Osaka (JP); Kaname Tomita, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/825,043

(22) Filed: Nov. 28, 2017

(65) Prior Publication Data

US 2018/0083396 A1 Mar. 22, 2018

Related U.S. Application Data

(63) Continuation of application No. PCT/JP2017/001645, filed on Jan. 19, 2017.

(30) Foreign Application Priority Data

Apr. 15, 2016 (JP) ..... 2016-081752

(51) Int. Cl.
*H01R 24/38* (2011.01)
*H01R 13/62* (2006.01)
(Continued)

(52) U.S. Cl.
CPC ..... *H01R 24/38* (2013.01); *H01R 13/42* (2013.01); *H01R 13/62* (2013.01); *H01R 13/641* (2013.01);
(Continued)

(58) Field of Classification Search
CPC ..... H01R 24/38; H01R 13/62; H01R 13/42; H01R 13/703
(Continued)

(56) References Cited

U.S. PATENT DOCUMENTS 5,421,738 A * 6/1995 Roberts ..... H01R 12/721 439/260
6,080,021 A * 6/2000 Weingartner ..... H01R 24/58 439/669
(Continued)

FOREIGN PATENT DOCUMENTS

JP 2016-038979 3/2016

OTHER PUBLICATIONS

International Search Report of PCT application No. PCT/JP2017/001645 dated Mar. 28, 2017.

*Primary Examiner* — Alexander Gilman
(74) *Attorney, Agent, or Firm* — Wenderoth, Lind & Ponack, L.L.P.

(57) ABSTRACT

A jack device includes an insertion portion configured to receive a plug through an open end along a first axis. The insertion portion has an opening and a terminal. The opening has a predetermined depth from the open end to an inside of the insertion portion. The opening has a first inner surface that is increasingly away from the first axis from the inside to the open end, and a second inner surface whose distance from a certain point on the first axis is shorter than a distance between the first inner surface and the certain point. The terminal is located further inside than the opening in a direction of the first axis and is opposite to the second inner surface in a direction crossing the first axis. The terminal comes into pressure contact with the plug when the plug is inserted into the insertion portion.

7 Claims, 7 Drawing Sheets

(51) Int. Cl.

| | |
|---|---|
| ***H01R 13/42*** | (2006.01) |
| ***H01R 13/703*** | (2006.01) |
| ***H01R 24/58*** | (2011.01) |
| ***H01R 13/641*** | (2006.01) |
| *H01R 107/00* | (2006.01) |

(52) U.S. Cl.
CPC ..... *H01R 13/703* (2013.01); *H01R 24/58* (2013.01); *H01R 2107/00* (2013.01)

(58) Field of Classification Search
USPC ..... 439/669
See application file for complete search history.

(56) References Cited

U.S. PATENT DOCUMENTS 6,478,594 B1 * 11/2002 Curtin ..... H01R 24/58 439/188
6,503,106 B1 * 1/2003 Suzuki ..... H01R 24/58 439/669
6,524,138 B1 * 2/2003 Li ..... H01R 24/58 439/669
6,808,404 B1 * 10/2004 Doyle ..... H01R 13/7031 200/51.1
7,281,956 B1 * 10/2007 Ju ..... H01R 13/6315 439/669
7,285,024 B1 * 10/2007 Tai ..... H01R 24/58 439/188
7,470,153 B2 * 12/2008 Han ..... H01R 24/58 439/669
7,618,294 B1 * 11/2009 Lin ..... H01R 13/701 200/51 R
7,717,755 B2 * 5/2010 Zhang ..... H01R 24/58 439/669
8,353,729 B2 * 1/2013 Dabov ..... H01R 24/58 439/668
8,616,922 B2 * 12/2013 Liu ..... H01R 24/58 439/669
8,998,648 B2 * 4/2015 Zhang ..... H01R 24/58 439/668
9,178,323 B2 * 11/2015 Ju ..... H01R 24/58
9,520,685 B2 * 12/2016 Zhao ..... H01R 12/721
D780,126 S * 2/2017 Kobayashi ..... D13/147
2006/0166561 A1 * 7/2006 Ma ..... H01R 24/78 439/668

* cited by examiner

JACK DEVICE

TECHNICAL FIELD

The present disclosure relates to a jack device that is electrically connected to a plug when the plug is inserted into the device.

BACKGROUND ART

Patent Literature 1 discloses a connector having an inclined guide surface that is tapered on the outer surface of the end wall so as to guide a terminal through the insertion opening. The connector offers the function of guiding a terminal to be inserted.

CITATION LIST

Patent Literature

PTL 1: Japanese Unexamined Patent Application Publication No. 2016-38979.

SUMMARY

The jack device according to the present disclosure includes an insertion portion configured to receive a plug through an open end along a first axis. The insertion portion has an opening and a terminal. The opening has a predetermined depth from the open end to an inside of the insertion portion. The opening has a first inner surface that is increasingly away from the first axis from the inside to the open end, and a second inner surface whose distance from a certain point on the first axis is shorter than a distance between the first inner surface and the certain point. The terminal is located further inside than the opening in a direction of the first axis and is opposite to the second inner surface in a direction crossing the first axis. The terminal comes into pressure contact with the plug when the plug is inserted into the insertion portion.

The jack device according to the present disclosure is useful to protect both a plug to be inserted into it and the terminals inside it.

DESCRIPTION OF EMBODIMENTS

Exemplary embodiments will be described in detail as follows with reference to the accompanying drawings. In the exemplary embodiments, the description of well-known matter and of substantially the same configuration as described earlier may be omitted to avoid redundancy and help those skilled in the art understand them easily.

Note that the attached drawings and the following description are provided to make those skilled in the art fully understand the present disclosure, and are not intended to limit the claimed subject matter.

First Exemplary Embodiment

Jack device 100 according to a first exemplary embodiment of the present disclosure will now be described with reference to FIGS. 1 to 5.

1-1. Structure

Figure 1:
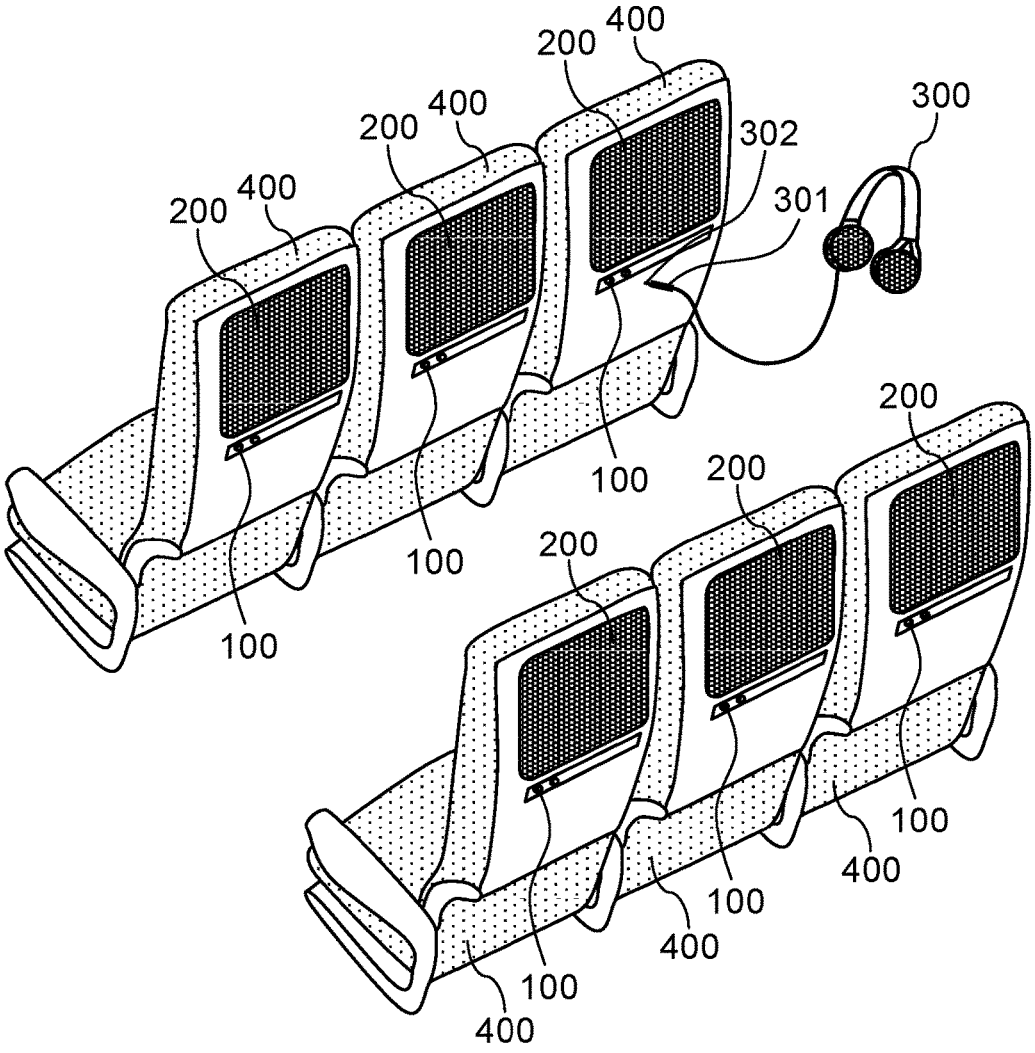
FIG. 1 is an overview inside an airplane where passenger seats are each equipped with the jack device according to a first exemplary embodiment.

FIG. 1 is an overview inside an airplane where passenger seats 400 are each equipped with jack device 100. Seats 400 each include device 100 and seat monitor 200. Device 100 receives plug 301 of headphone 300 (an external device). Plug 301 has tip 302. Passengers sitting on seats 400 can enjoy videos on seat monitor 200. They can also enjoy music with headphone 300 on their head and with plug 301 of headphone 300 in device 100.

Figure 2:
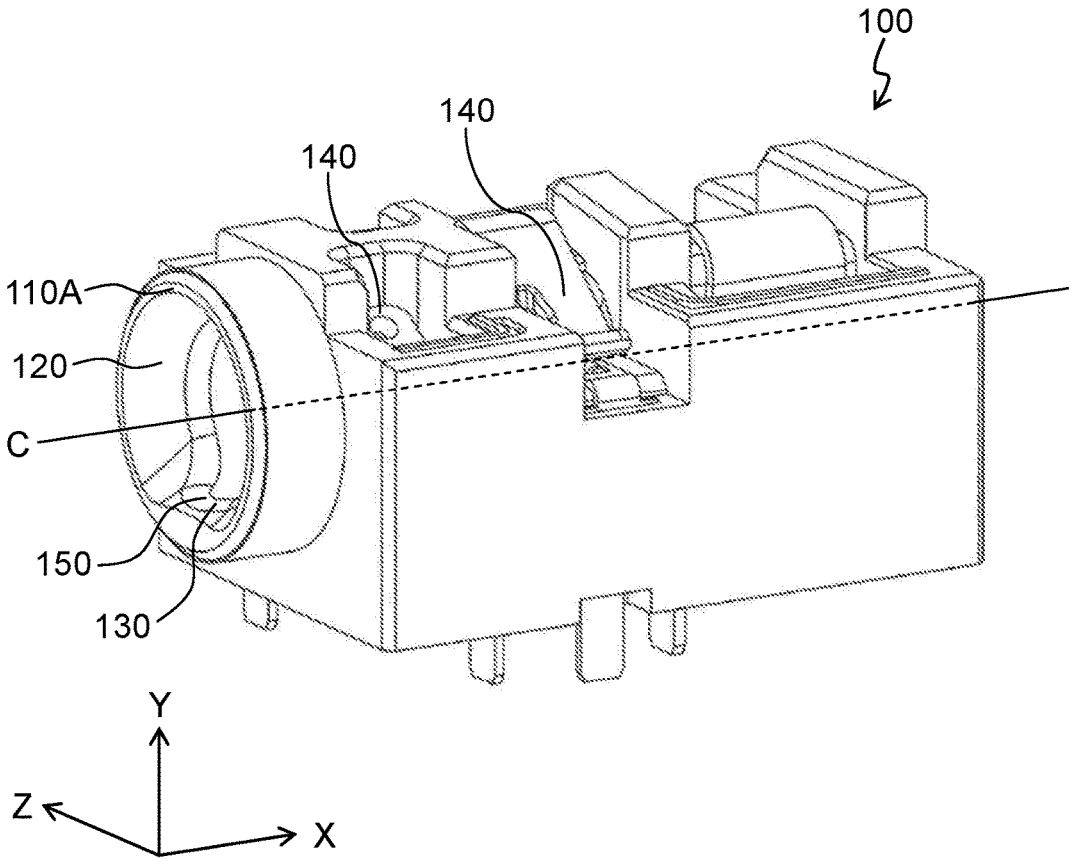
FIG. 2 is an external perspective view of the jack device according to the first exemplary embodiment.
Figure 3A:
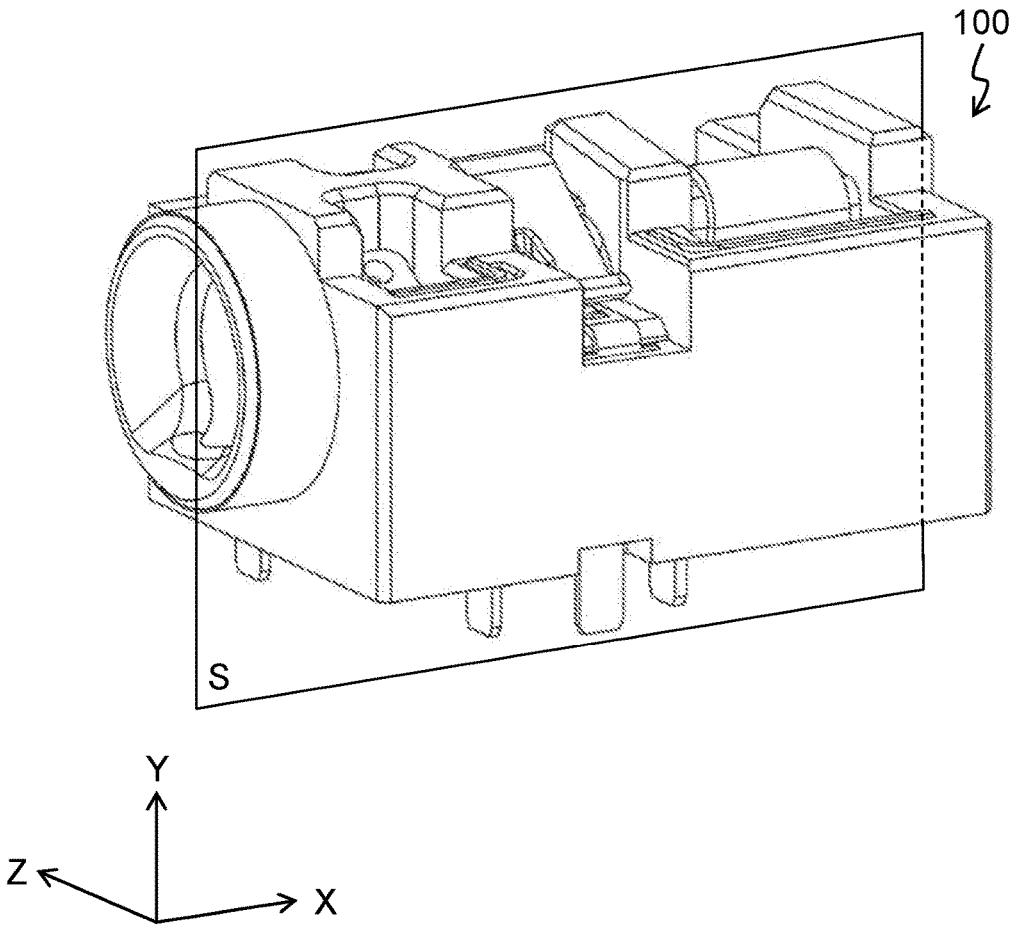
FIG. 3A is an external perspective view of the jack device according to the first exemplary embodiment, together with a cross section S.
Figure 3B:
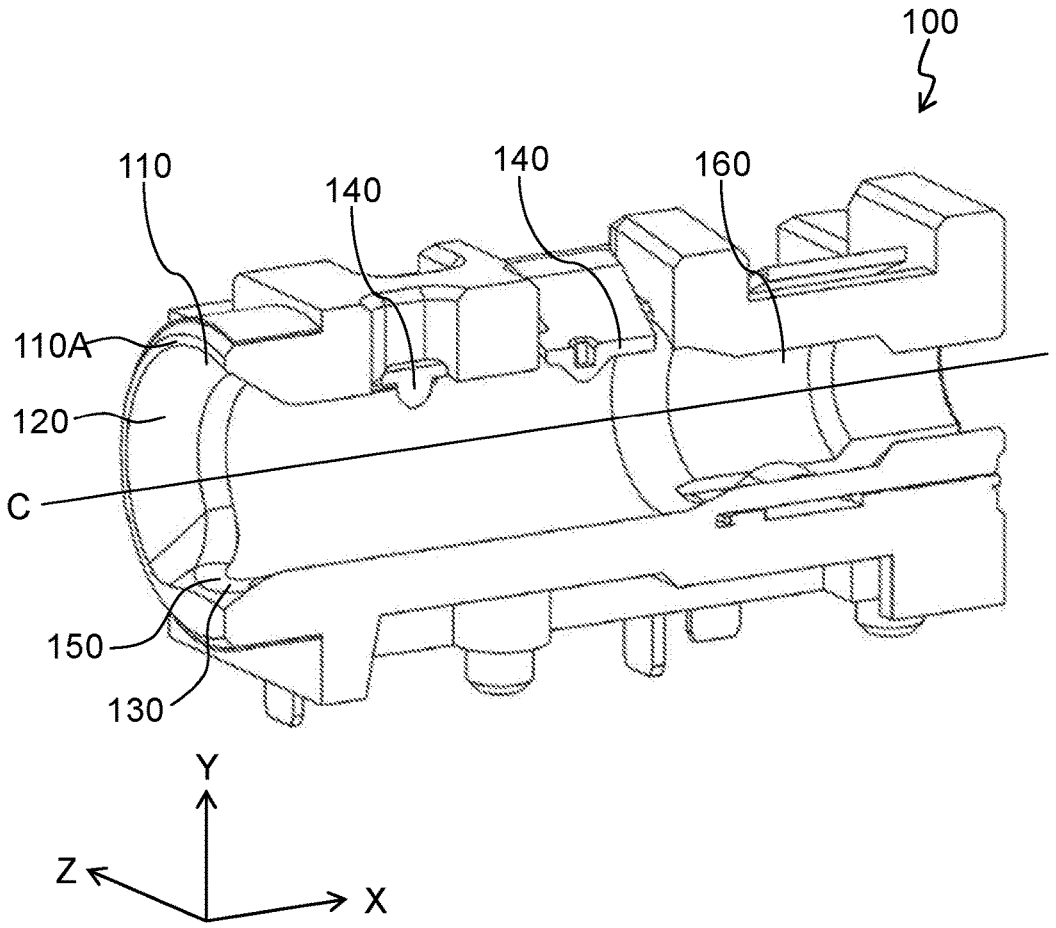
FIG. 3B is a perspective view of the jack device according to the first exemplary embodiment taken along the cross section S of FIG. 3A.
Figure 4:
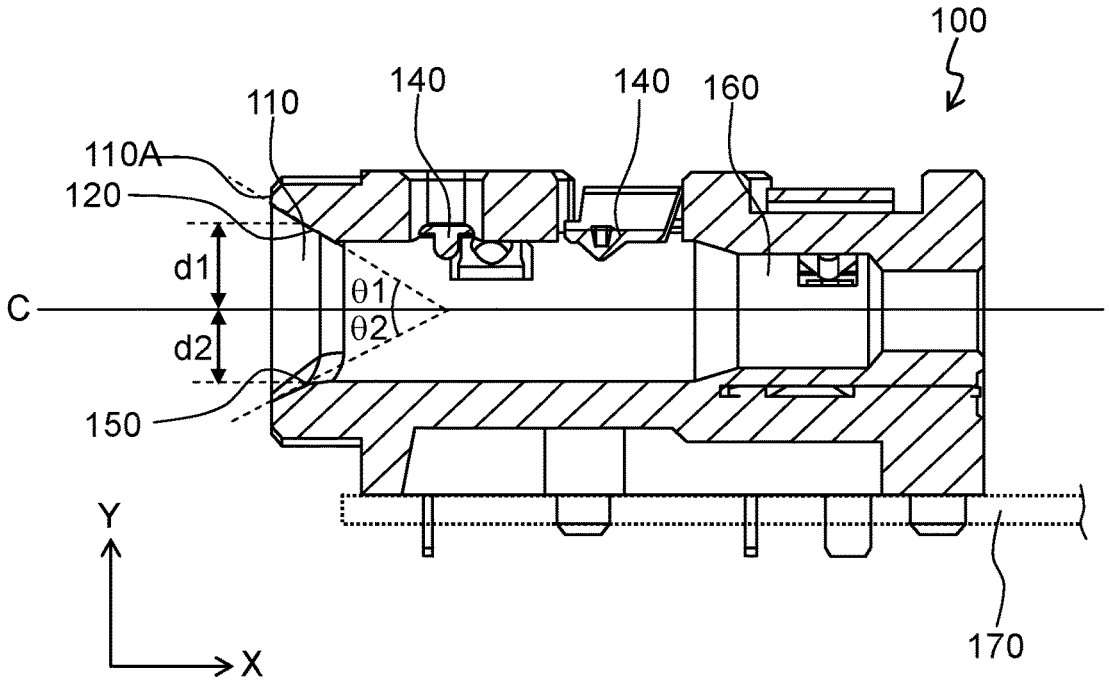
FIG. 4 is a sectional view of the jack device according to the first exemplary embodiment taken along the cross section S of FIG. 3A.
Figure 5:
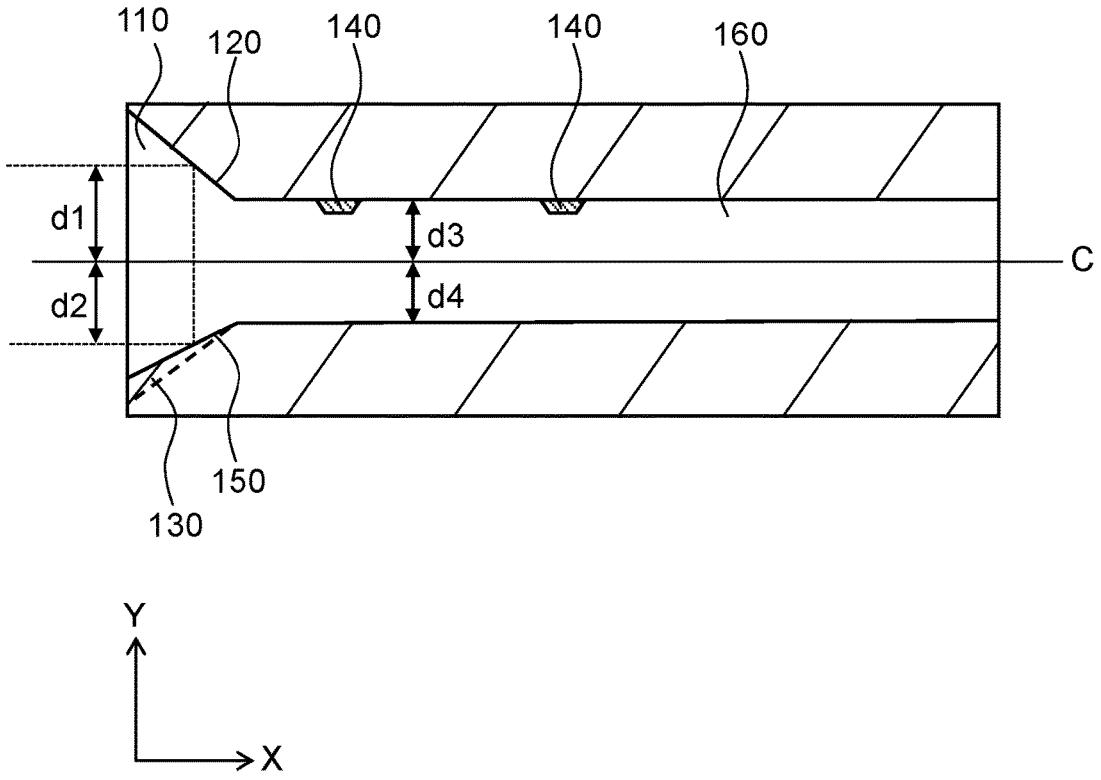
FIG. 5 is a schematic sectional view of the jack device according to the first exemplary embodiment.

FIG. 2 is an external perspective view of jack device 100. FIG. 3A is an external perspective view of device 100, together with the cross section S. FIG. 3B is a perspective view of device 100 taken along the cross section S. FIG. 4 is a sectional view of device 100 taken along the cross section S. FIG. 5 is a schematic sectional view of device 100 taken along the cross section S. In each of FIGS. 2 to 5, the direction in which plug 301 is inserted or removed into/from device 100 is defined as the X axis. The direction in which plug 301 is inserted into device 100 is defined as the positive X direction. The direction in which plug 301 is removed from device 100 is defined as the negative X direction. The Y axis is defined to be perpendicular to the X axis. The Z axis is defined to be perpendicular to the X and Y axes. In each of FIGS. 2 to 5, the Y axis is vertical, the positive Y direction is upward, and the negative Y direction is downward.

Jack device 100 has insertion portion 160 into which plug 301 is inserted in the positive X direction. Insertion portion 160 has opening 110 and a plurality of terminals 140 that come into pressure contact with plug 301 when plug 301 is inserted. The straight line parallel to the X axis and passing through the center of insertion portion 160 is defined as the straight line C (first axis). The line C coincides with the center line of plug 301 when plug 301 is inserted into device 100. In other words, plug 301 can be inserted into device 100 from outside to inside along the line C. The cross section S shown in FIG. 3A is a plane parallel to the X-Y plane and is slightly closer to the front than the line C.

Opening 110 is of approximately cylindrical shape centered around the line C. Opening 110 has open end 110A open to the atmosphere. Opening 110 has a predetermined depth from open end 110A toward the inside of insertion portion 160. The depth is the length along the line C. Plug 301 is inserted through open end 110A of opening 110 until tip 302 of plug 301 reaches the back of insertion portion 160.

Opening 110 is divided into first and second regions. The first region is an arc-shaped region with a predetermined central angle θf around the line C on a cross section of opening 110 that is perpendicular to the line C. The second region is an arc-shaped region with a predetermined central angle θs around the line C on the cross section of opening 110 that is perpendicular to the line C. In the present exemplary embodiment, the sum of the central angles θf and θs is 360 degrees.

The surface of the first region that is on the side facing the line C (also referred to as the "inner diameter side") is defined as the inner surface of the first region (first inner surface). The inner surface of the first region is also referred to as first tapered surface 120, which is increasingly away from the line C (in the negative X direction) from inside to outside, or has a gradually increasing inner diameter.

The second region is the region of opening 110 that is below the line C. The surface of the second region that is on the side facing the line C is defined as the inner surface of the second region (second inner surface). The inner surface of the second region is also referred to as second tapered surface 150, which is increasingly away from the line C (in the negative X direction) from inside to outside. Second tapered surface 150 projects more toward the line C than first tapered surface 120 does, and therefore can be said to have projection 130.

Thus, the inner surface of opening 110 is composed of first tapered surface 120 and second tapered surface 150. First tapered surface 120 accounts for more than half of the area of the inner surface of opening 110. Each of first tapered surface 120 and second tapered surface 150 is part of the side surface of a cone whose vertex and base center are on the line C.

As shown in FIG. 4, assuming that first tapered surface 120 is part of the side surface of a cone, there is an angle θ1 between the generatrix of the cone and the line C. Similarly, assuming that second tapered surface 150 is part of the side surface of the cone, there is an angle θ2 between the generatrix and the line C. In this case, the angle θ1 is greater than the angle θ2, which can be shown by the formula, θ1>θ2.

Further, as shown in FIG. 5, assume that the distance between a certain point on the line C and first tapered surface 120 is a distance d1, and the distance between the certain point and second tapered surface 150 is a distance d2. In this case, the distance d2 is shorter than the distance d1. In the region of insertion portion 160 that is located further inside than opening 110 in the positive X direction, the distance d3 between the line C and the inner surface above the line C is approximately equal to the distance d4 between the line C and the inner surface below the line C.

Terminals 140 are located further inside insertion portion 160 than opening 110 in the positive X direction along the X axis. Terminals 140 are located opposite to the inner surface of the second region, that is, located opposite to second tapered surface 150 on lines that cross the line C. In other words, second tapered surface 150 is located below the line C, and terminals 140 are located above the line C. Terminals 140 are not located opposite to the inner surface of the first region, that is, not located opposite to first tapered surface 120 on lines that cross the line C.

The number of terminals 140 corresponds to the number of electrodes of plug 301 that is to be inserted into jack device 100. The locations of terminals 140 correspond to the locations of the electrodes of plug 301. Terminals 140 come into pressure contact with the electrodes of plug 301 when plug 301 is inserted. This makes terminals 140 and the electrodes electrically connected to each other.

Jack device 100 is coupled with printed circuit 170 shown in the dotted line of FIG. 4. Device 100 is further coupled with seat monitor 200 via printed circuit 170. Terminals 140 are fixed to printed circuit 170 with plate springs. The plate springs are elastically deformed and come into pressure contact with the electrodes of plug 301 when plug 301 is inserted into device 100.

1-2. Effects

As described above, jack device 100 according to the present exemplary embodiment has insertion portion 160 into which plug 301 is inserted along the line C from outside to inside. Insertion portion 160 has opening 110 and includes terminals 140. Opening 110 has a predetermined depth from open end 110A toward the inside of insertion portion 160. Opening 110 includes a first inner surface (e.g., first tapered surface 120) and a second inner surface (e.g., second tapered surface 150). The first inner surface is increasingly away from the line C from the inside to open end 110A. The distance d2 between the second inner surface and a certain point on the line C is shorter than the distance d1 between the first inner surface and the certain point. Terminals 140 are located further inside than opening 110, and opposite to the second inner surface on lines that cross the line C. Terminals 140 come into pressure contact with plug 301 when plug 301 is inserted.

The inner surface of opening 110 is increasingly away from the line C from inside to outside. As a result, when subjected to a load in the Y axis direction, plug 301 can be easily removed from insertion portion 160 without being broken inside it while plug 301 is in jack device 100. If, however, the inner surface of opening 110 were very away from the line C, plug 301 could be removed easily, but could be inserted at a larger angle with respect to the line C. As a result, if the first inner surface (e.g., first tapered surface 120) were formed throughout the inner surface of opening 110, tip 302 of obliquely inserted plug 301 could come into contact with terminals 140 in a direction to apply a load in the positive X direction and could overload terminals 140. To avoid this happening, in jack device 100 according to the present exemplary embodiment, the inner surface of opening 110 has a second inner surface (e. g., second tapered surface 150) on the region that is opposite to terminals 140 below the line C, that is, on lines that cross the line C. The second inner surface is closer to the line C than the first inner surface is. Therefore, the angle between the line C and plug 301 is smaller when plug 301 is inserted obliquely upward than when plug 301 is inserted in a different direction. As a result, compared with the case with no second inner surface, tip 302 of plug 301 less easily comes into contact with terminals 140 and thus reduces the load to terminals 140. In short, device 100 reduces both the load to terminals 140 and the load to plug 301 applied inside. This is how device 100 protects inserted plug 301 and terminals 140. Device 100 according to the present exemplary embodiment is suitably used in airplanes because electronic devices used in them are required to have high durability.

In jack device 100 according to the present exemplary embodiment, printed circuit 170 and terminals 140 are oppositely located with respect to the line C as shown in FIG. 4. When printed circuit 170 and terminals 140 are away from each other, long plate springs can be used for fixing terminals 140 to printed circuit 170. Long plate springs have a low spring constant, thereby reducing the load applied during their elastic deformation. If printed circuit 170 and terminals 140 were fixed in their relative positions, the design would often cause terminals 140 to be located in the position toward which plug 301 is inserted. Meanwhile, according to the present exemplary embodiment, the presence of the second inner surface (e.g., second tapered surface 150) reduces the angle between plug 301 and the line C. This makes tip 302 of plug 301 unlikely to come into contact with terminals 140, thereby reducing the load to terminals 140.

Furthermore, according to the present exemplary embodiment, the first inner surface is first tapered surface 120, which is increasingly away from the line C from the inside to open end 110A. This facilitates the insertion and removal of plug 301.

Furthermore, according to the present exemplary embodiment, the second inner surface is second tapered surface 150, which is increasingly away from the line C from the inside to open end 110A. This also facilitates the insertion and removal of plug 301.

Furthermore, according to the present exemplary embodiment, the first inner surface accounts for more than half of the area of the inner surface of opening 110. This also facilitates the insertion and removal of plug 301.

Furthermore, according to the present exemplary embodiment, terminals 140 are not located opposite to the first inner surface on lines that cross the line C. When a plurality of terminals 140 are used, the outermost one of terminals 140 is not located opposite to the first inner surface on a line that crosses the line C. This reduces the load to terminals 140.

Another Exemplary Embodiment

The first exemplary embodiment has been described as a technical example of the present application, and the techniques of the present disclosure are not limited to it and are applicable to other exemplary embodiments provided with modification, replacement, addition, omission, etc. Furthermore, components in the first exemplary embodiment may be combined to create another exemplary embodiment.

The different exemplary embodiment will now be described as follows.

Figure 6:
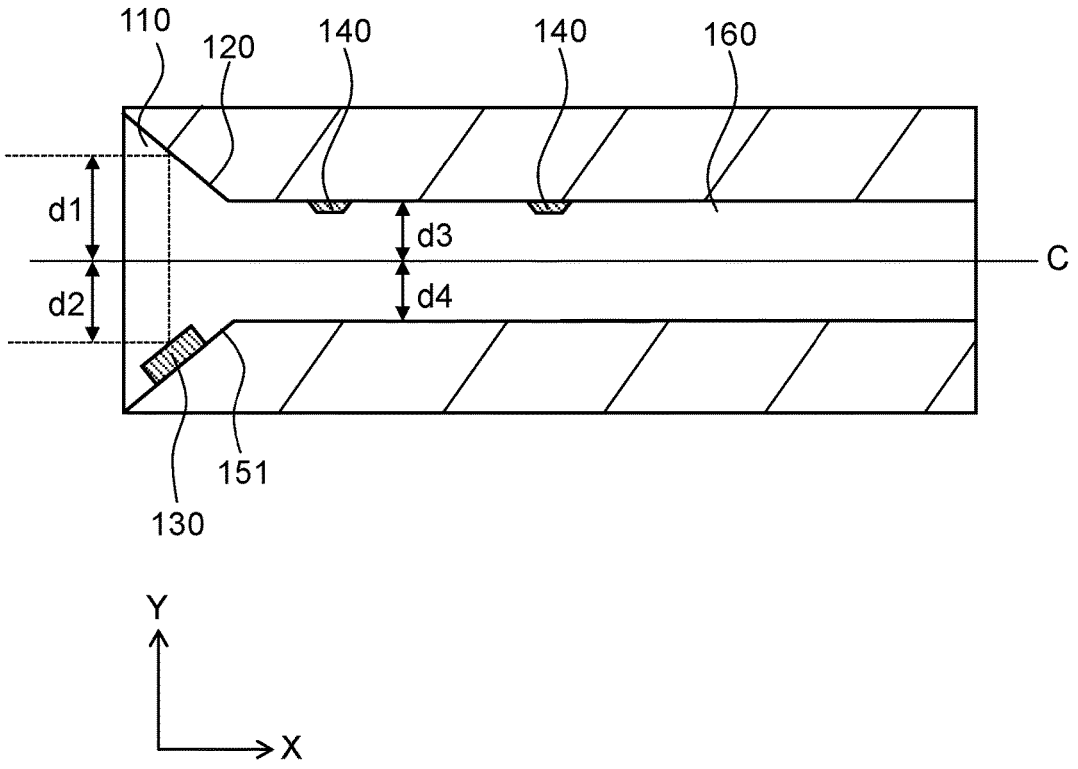
FIG. 6 is a schematic sectional view of a jack device according to an exemplary embodiment different from the first exemplary embodiment.

In the first exemplary embodiment, second tapered surface 150 has projection 130 as its part. In other words, the second inner surface as a whole is shaped as part of the side surface of a cone. However, the second inner surface does not necessarily have to be shaped like the side surface of a cone or be tapered. Alternatively, as shown in FIG. 6, second inner surface may have projection 130 on tapered surface 151 inclined at the same angle as first tapered surface 120. In this case, the angle between the straight line C and the tangent line of projection 130 is smaller than the angle between the line C and first tapered surface 120. Furthermore, because of the presence of projection 130, the distance d2 between a certain point on the line C and the second inner surface is shorter than the distance d1 between the certain point on the line C and first tapered surface 120 (the first inner surface). This reduces the angle between plug 301 and the line C. As a result, tip 302 of plug 301 is less likely to come into contact with terminals 140, thereby reducing the load to terminals 140. The distance d2 does not necessarily have to be shorter than the distance d1 throughout the second inner surface. As shown in FIG. 6, the distance d2 may be shorter than the distance d1 only in the region including projection 130.

Furthermore, in the first exemplary embodiment, opening 110 has first tapered surface 120. First tapered surface 120, however, may be replaced by a different-shaped surface such as a surface with steps. However, the inner diameter side of opening 110 is preferably tapered as in the first exemplary embodiment for easier insertion and removal of plug 301.

In the first exemplary embodiment, all of terminals 140 are located above the line C, or in other words, located opposite to second tapered surface 150 with respect to the line C. Alternatively, however, only the one of terminals 140 that is closest to the negative X direction, or in other words, closest to opening 110 may be located above the line C, and the other terminals 140 may be located below the line C. This is because the terminal 140 that is closest to opening 110 is most likely to come into contact with tip 302 of plug 301 when plug 301 is inserted obliquely.

Opening 110, which is divided into two regions (the first and second regions) in the present exemplary embodiment, may alternatively be divided into three regions. In other words, the inner surface of opening 110 may have another inner surface in addition to the first and second inner surfaces.

INDUSTRIAL APPLICABILITY

The jack device according to the present disclosure is applicable to electrical devices in which the jack device can be electrically connected to a plug inserted therein. Specific examples of the electrical devices include TVs, personal computers, smartphones, and mobile phones.

What is claimed is:

1. A jack device comprising an insertion portion configured to receive a plug through an open end along a first axis, the insertion portion comprising:

an opening having a predetermined depth from the open end to an inside of the insertion portion, the opening comprising:

a first inner surface increasingly away from the first axis from the inside to the open end; and a second inner surface whose distance from a certain point on the first axis is shorter than a distance between the first inner surface and the certain point; and a terminal located further inside than the opening in a direction of the first axis, the terminal being opposite to the second inner surface in a direction crossing the first axis and being configured to come into pressure contact with the plug when the plug is inserted into the insertion portion.

2. The jack device according to claim 1, wherein the first inner surface comprises a first tapered surface increasingly away from the first axis from the inside to the open end.

3. The jack device according to claim 1, wherein the second inner surface comprises a second tapered surface increasingly away from the first axis from the inside to the open end.

4. The jack device according to claim 1, wherein the first inner surface comprises a first tapered surface increasingly away from the first axis from the inside to the open end, the second inner surface comprises a second tapered surface increasingly away from the first axis from the inside to the open end, and an angle between the first tapered surface and the first axis is greater than an angle between the second tapered surface and the first axis.

5. The jack device according to claim 1, wherein the second inner surface comprises a projection.

6. The jack device according to claim 1, wherein the first inner surface accounts for more than half of an area of an inner surface of the opening.

7. The jack device according to claim 1, wherein the terminal is not located opposite to the first inner surface in a direction crossing the first axis.

* * * * *